US006170825B1

(12) United States Patent
Pflum

(10) Patent No.: US 6,170,825 B1
(45) Date of Patent: Jan. 9, 2001

(54) DUAL LEVEL BOARD GAME AND METHOD OF PLAY

(76) Inventor: Marty Lynn Pflum, 11302 Esperanza, Austin, TX (US) 78739

( * ) Notice: Under 35 U.S.C. 154(b), the term of this patent shall be extended for 0 days.

(21) Appl. No.: 09/197,546

(22) Filed: Nov. 23, 1998

(51) Int. Cl.[7] ..... A63F 3/02

(52) U.S. Cl. ..... 273/261; 273/255; 273/258; 273/262

(58) Field of Search ..... 273/236, 241, 273/242, 288, 291, 287, 260, 261

(56) References Cited

U.S. PATENT DOCUMENTS

| | | | |
|---|---|---|---|
| 437,838 | * | 10/1890 | Sperl . |
| 1,877,154 | | 9/1932 | Weaver . |
| 3,918,715 | | 11/1975 | Puglis . |
| 3,920,247 | * | 11/1975 | Jenkins . |
| 3,937,471 | * | 2/1976 | Brennan . |
| 3,964,747 | * | 6/1976 | Balmforth . |
| 4,045,030 | * | 8/1977 | Strozewski . |
| 4,184,685 | | 1/1980 | Wilson . |
| 4,333,654 | * | 6/1982 | Allain . |
| 4,580,787 | * | 4/1986 | Baker . |
| 4,805,915 | * | 2/1989 | Lamle . |
| 5,031,917 | | 7/1991 | Greene . |
| 5,443,268 | | 8/1995 | Mayfield et al. . |
| 5,556,099 | | 9/1996 | Mardirosian . |
| 5,678,819 | | 10/1997 | Underwood . |
| 5,826,880 | * | 9/1998 | Cooper . |

* cited by examiner

*Primary Examiner*—Jeanette Chapman
*Assistant Examiner*—Vishu Mendiratta
(74) *Attorney, Agent, or Firm*—Joseph F. Long

(57) ABSTRACT

Dual hexagon shaped playing fields composed of smaller hexagons of two different colors vertically separated for visibility with each player starting with the same number of three different shaped playing pieces with each piece being limited differently in movement and capture capability with such limitations designed to make each piece of approximately the same worth to a player in his effort to capture the opponent's pieces and conscript the captured pieces for his use.

4 Claims, 7 Drawing Sheets

DUAL LEVEL BOARD GAME AND METHOD OF PLAY

BACKGROUND OF THE INVENTION

There is a continuing market or need for board games of many types. This invention is a new type of intellectually challenging game such as chess but differs markedly from the original chess game and the many variations thereof in prior art. In chess the pieces have differing values and greatly differing capabilities and a game may essentially be won when one player captures a major piece, such as the king of the opponent.

In this game there are three different groups of pieces with each group having different capabilities but with similar worth to the player in his effort to capture the other player's pieces. The player wins by using the synergistic effect of having the proper pieces in the proper location at the proper time.

In this invention the power or directions in which a piece may capture and the mobility are separate concepts and these are varied to make each of the three groups of pieces have approximately the same worth in their use to capture the opposing player's pieces.

The playing board differs markedly from the familiar chess board in that there are no all powerful positions and all playing pieces are of similar worth. With experimentation the inventor has found that a two level board, each level with a playing field having a total of thirty seven blue plus white hexagons and with each player having a total of ten pieces the game is sufficiently complex to be interesting and intellectually challenging and may be concluded in one to two hours. A second embodiment has dual playing fields with sixty one hexagons and each player starts with eighteen pieces. A game on the second embodiment could require three to five hours to conclude.

In a preferred embodiment of the playing pieces each of the three types of movable pieces has a walnut or walnut colored side and a maple or maple colored side. One player starts with the walnut sides showing and the other player starts with the maple side showing. Each player attempts to capture the other player's pieces and as he does conscripts them for his own by simply turning them over.

At the start each player has four pieces called the Halberd that have six directions of capture but can move only one hexagon at a time; has four pieces called the Saebel that have four directions of capture and that can move two hexagons of the same color at a time; and has two pieces called the Lantz that can move up to six hexagons but is the most limited in its direction of capture. The names A, B, C or many other names could also be used for the playing pieces.

The concept of momentum is introduced by allowing a player who wins four or more pieces to move more pieces at a time. The equipment may be used for a single game or as a campaign of several games. In a campaign a player who is losing may choose to lose to cut his losses on a particular game since the winner of total number of pieces wins the campaign. With the sixty one hexagon playing board available the campaign could be played using both boards. In some embodiments the sixty one hexagon playing fields could be on the lower side of the boards having the thirty seven hexagon playing fields so that the more difficult second embodiment could be used by inverting the playing unit on different games of the campaign.

Obviously one of normal skill in the art could make changes in the playing field size, the number of playing pieces, and even the playing rules, we wish therefor only to be limited to the spirit and purpose as outlined in these specifications and claims.

SUMMARY OF THE INVENTION

The equipment of the invention comprises similar dual hexagon shaped playing fields composed of preferably white and blue hexagons, held on rectangles one above the other and separated for visibility. Each one of the small hexagons is identified with a letter or number to aid the player in making certain that a vertical move is properly made. Each player starts with an equal number of playing pieces. Each playing piece has the same color on one side and the same but differing color on the other side.

The object of the game is for a player to capture the opposing player's pieces. In a preferred embodiment each player has two pieces of one shape and one capability for movement and capture, has four pieces of a second shape and a second capability for movement and capture, and four pieces of a third shape and a third capability for movement and capture. Each player has ten pieces at the start of the game. When a player captures a piece he conscripts the piece for his own team by turning the piece over to his team's color and placing the conscripted piece in his own back row. A player must then guard his back row to be able to make use of the conscripted pieces. Each of the three types of pieces has differing move limitations and differing capture capabilities. The inventor intended for each piece to be of about the same worth to a player in his efforts to capture the opponent's pieces. To win a player must consider the capabilities of his pieces in their location on both playing fields, the capabilities of the opposing player's pieces in their location on both playing fields, the particular location of pieces that may capture by a vertical movement, and the immediate and longer range consequences of his contemplated movement of each movable piece. The thought processes may be likened to that of a local battle field commander or the owner of a business.

DETAILED DESCRIPTION OF THE INVENTION

Figure 1:
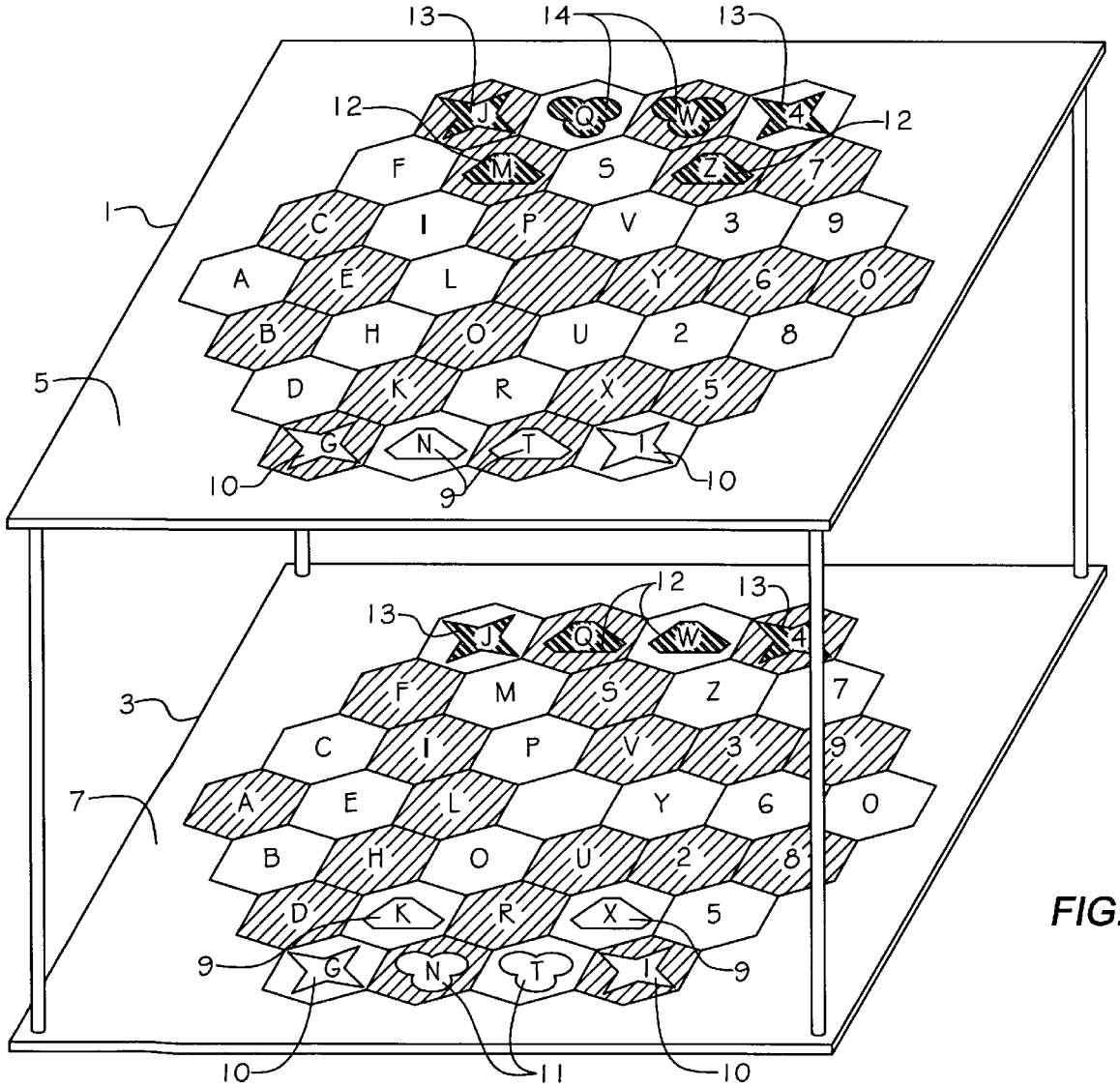
FIG. 1 shows the body of the game, dual boards, each with a dual colored hexagon playing field and the movable pieces of the game properly placed in the start of the playposition.

The invention may best be described from the drawings. FIG. 1 shows the equipment to play the game in the first embodiment of the invention. The top rigid rectangle 1 may be a transparent, translucent or opaque material with opaque being preferable. The top rectangle 1 is supported about 6 inches above the bottom rectangle 3 with rigid or foldable legs 6. The top playing field 5 is in the shape of a hexagon and is formed by eighteen hexagons of one color, preferably white and nineteen hexagons of a second color, preferably blue. All the hexagons except one in a central location are identified with letters or numbers.

The bottom rectangle 3 is similar to the top rectangle and is preferably made from a rigid opaque material. The bottom or lower playing field is formed from two different colored hexagons and if the top playing field is formed from blue and white hexagons the bottom playing field will have eighteen blue and nineteen white hexagons. When a player moves a playing piece straight down as is required the piece will be on an opposite color from the starting point. The hexagons on the bottom field are identified the same as on the top field so that a player may identify the hexagon to make certain he is moving vertically as required.

In the preferred embodiment each player starts the game with ten playing pieces in place as shown. The ten playing pieces consist of two of a trefoil shape called a Lantz, four of a star shape called a Saebel and four of a truncated triangle shape called a Halberd. The pieces for the first player with the maple side up or the maple pieces are labelled 9 for the Halberd, 10 for the Saebel and 11 for the Lantz. The pieces for the second player with the walnut side up are labeled 12 for the Halberd, 13 for the Saebel and 14 for the Lantz. The pieces and their differing capabilities are fully discussed with the numbers being consistent in all the drawings.

Figure 2:
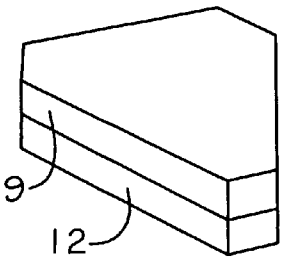
FIG. 2 shows one of the play pieces.
Figure 3:
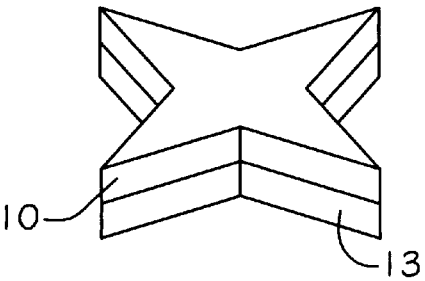
FIG. 3 shows a second of the play pieces
Figure 4:
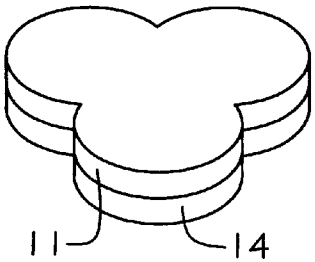
FIG. 4 shows the third type of play piece.

In FIG. 2 the dual layer Halberd is shown with maple side 9 and walnut side 12. In FIG. 3 the dual layer Saebel is shown with maple side 10 and walnut side 13. In FIG. 4 the dual layer Lantz is shown with maple side 11 and walnut side 14. When a piece is captured by a player it is conscripted into the player's group by simply turning it over; thus there are always twenty pieces on the board.

Figure 5:
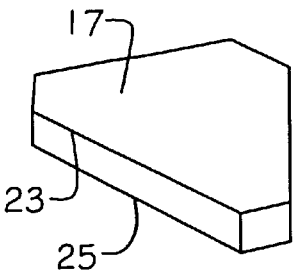
FIGS. 5, 6, and 7 show playing pieces similar in size and shape to FIGS. 2, 3, and 4 but formed in a single layer with dual colors on each piece.
Figure 6:
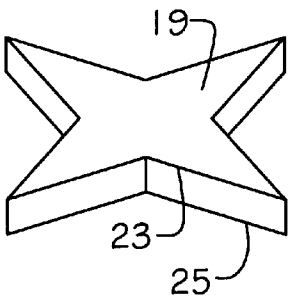
Figure 7:
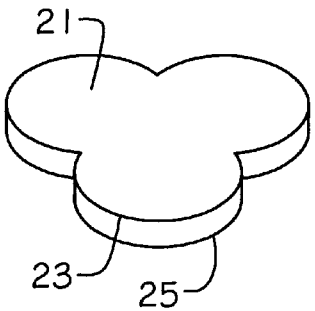

FIGS. 5, 6, and 7 show a Halberd 17, a Saebel 19, and a Lantz 21, respectively. Each of the pieces are a single layer and have an upper color 23 and a different lower color 25.

The inventor intended for a winning player to consider the concepts of logistics, of equal worth pieces, of equal worth positions except for starting positions, of economics, of campaigning and of momentum. The Halberd, the Saebel, and the Lantz each have differing capture abilities and differing movement abilities. Momentum is achieved by allowing a player who has 14 pieces to move two different pieces at his turn; allowing a player with 15 pieces to move three different pieces for his turn and allowing a player with 16 or more pieces to move four different pieces for his turn.

In the preferred embodiment one player starts with one Halberd 9 on hexagon K and one Halberd 9 on hexagon X on the lower level playing field, or lower playing field 7, FIG. 1 and one Halberd 9 on hexagon N and one Halberd 9 on hexagon T on the upper playing field 5, FIG. 1 with Halberd 9 being with the maple side up. The other player starts with one Halberd 12 on hexagon Q and one Halberd 12 on hexagon W on the lower playing field and one Halberd 12 on hexagon M and one Halberd 12 on hexagon Z on the upper playing field with Halberd 12 being with the walnut side up. The Halberd has six directions of capture while moving one hexagon horizontally. Thus the Halberd may capture an other players piece that is adjacent to any side of the Halberds location. It must always move to an unoccupied hexagon to move vertically. It cannot capture vertically. Starting from it's own back row only it may move one move of two non-capturing hexagons but since it cannot jump the hexagons must be unoccupied.

When a player captures and conscripts a piece he must put the conscript in his (the player's) back row. Thus a player must guard his back row to make maximum use of conscripts. If he has no vacant spot in the back row he must hold the conscript out of play until he does have a vacancy.

Figure 10:
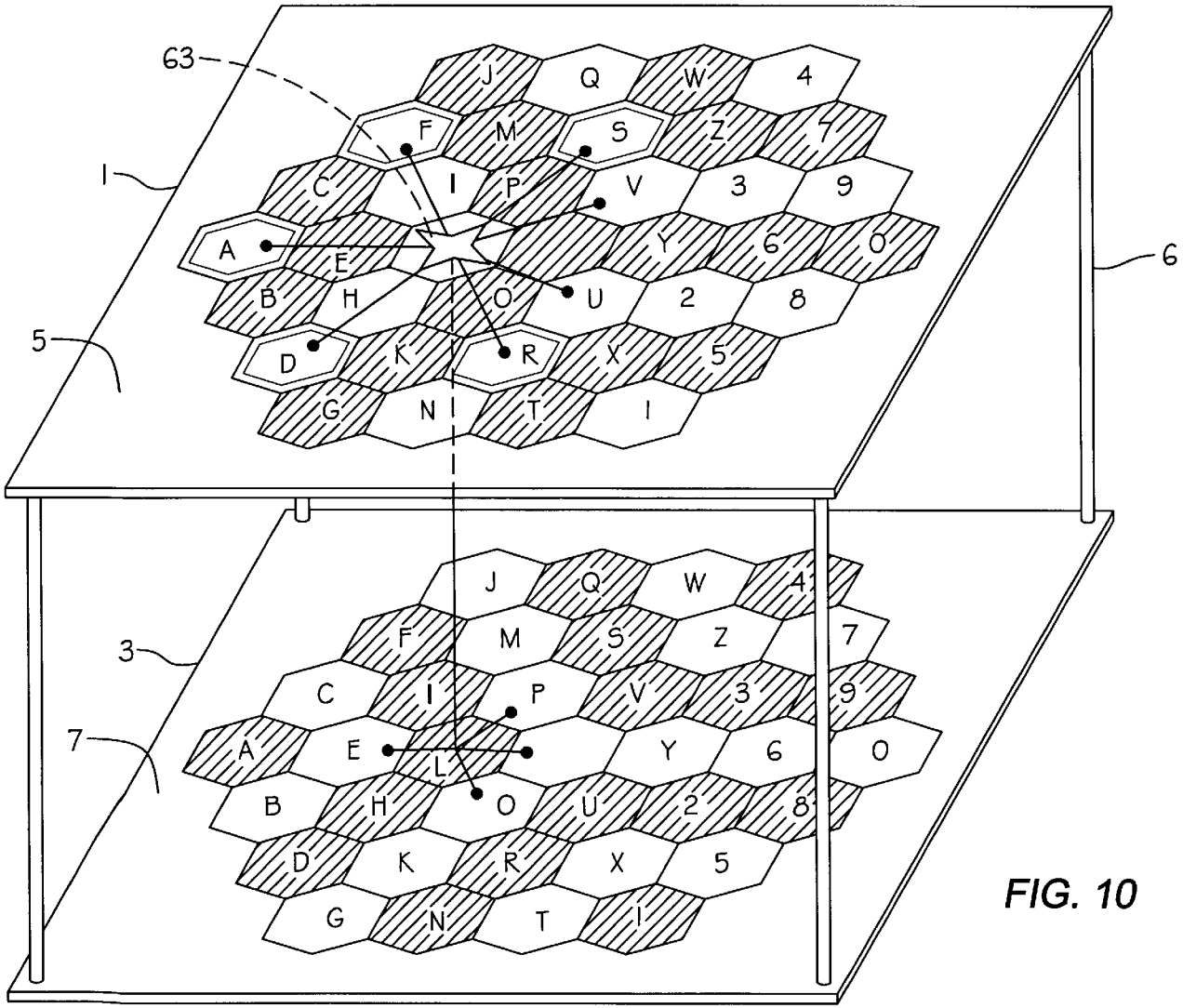
FIG. 10 shows the possible non capture horizontal moves of the Saebel and the vertical move from a first color to a second color and the ability to capture an opponents piece that is adjacent to and on the first color after its vertical move.

In the preferred embodiment a first player starts with one Saebel 10 on hexagon G and one Saebel 10 on hexagon 1 on the lower level playing field 7, FIG. 1 and starts with one Saebel 10 on hexagon G and one Saebel 10 on hexagon 1 on the upper level playing field 5, FIG. 1, for a total of four Saebels. Each Saebel as shown in FIG. 1 the second player starts with two Saebels 13 similarly located on the lower field 7 and two Saebels 13 on the upper playing field 5 for a total of four Saebels must always end it's move on a hexagon that is the same color as the starting color. The Saebel always moves two hexagons and can jump two hexagons provided that it does not end its movement adjacent to the starting hexagon. As shown in FIG. 10 the Saebel has four directions of capture since it must end its move on its starting color and therefor captures always on the second hexagon from its starting position after first moving vertically. It may jump past an occupied hexagon on the first hexagon of its move.

Figure 9:
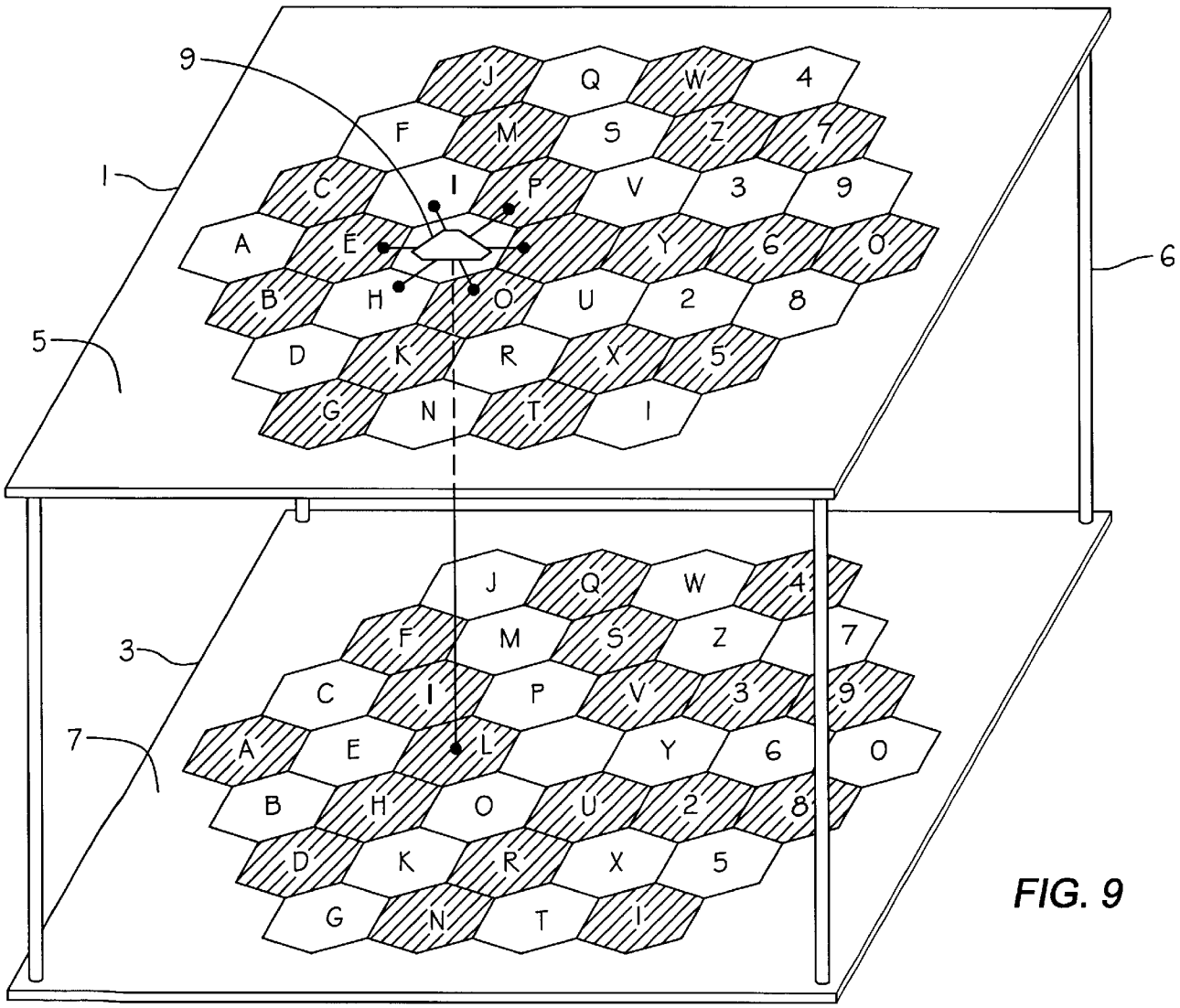
FIG. 9 illustrates the upward vertical move of the Halberd and the horizontal move to capture an adjacent players piece.

As shown in FIG. 9 the Saebel may also go directly vertical to an opposite color for the first part of its move even if the hexagon below is occupied and it may capture on the second part of its move because it will then be on its own color.

When a maple colored Saebel is captured it is turned over by the new owner to become part of the new owner's walnut team but must be placed on its original colored hexagon on the new owner's back row. This further emphasizes the necessity for each player to maintain control of his back row.

Figure 11:
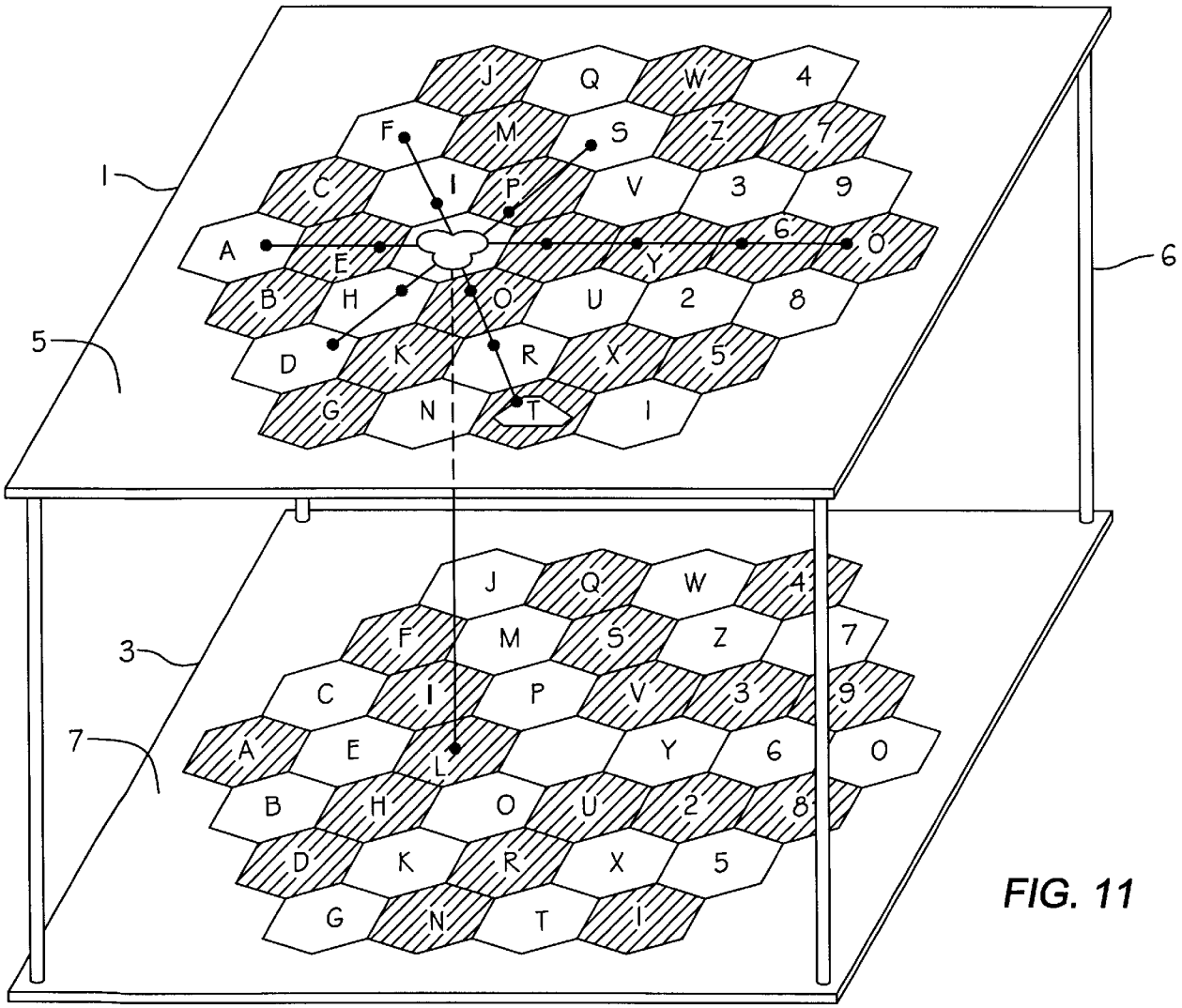
FIG. 11 shows the normal movement of the Lantz in six horizontal directions where it may not move over or capture an opponents piece and a vertical move wherein it may capture an opponents piece.
Figure 12:
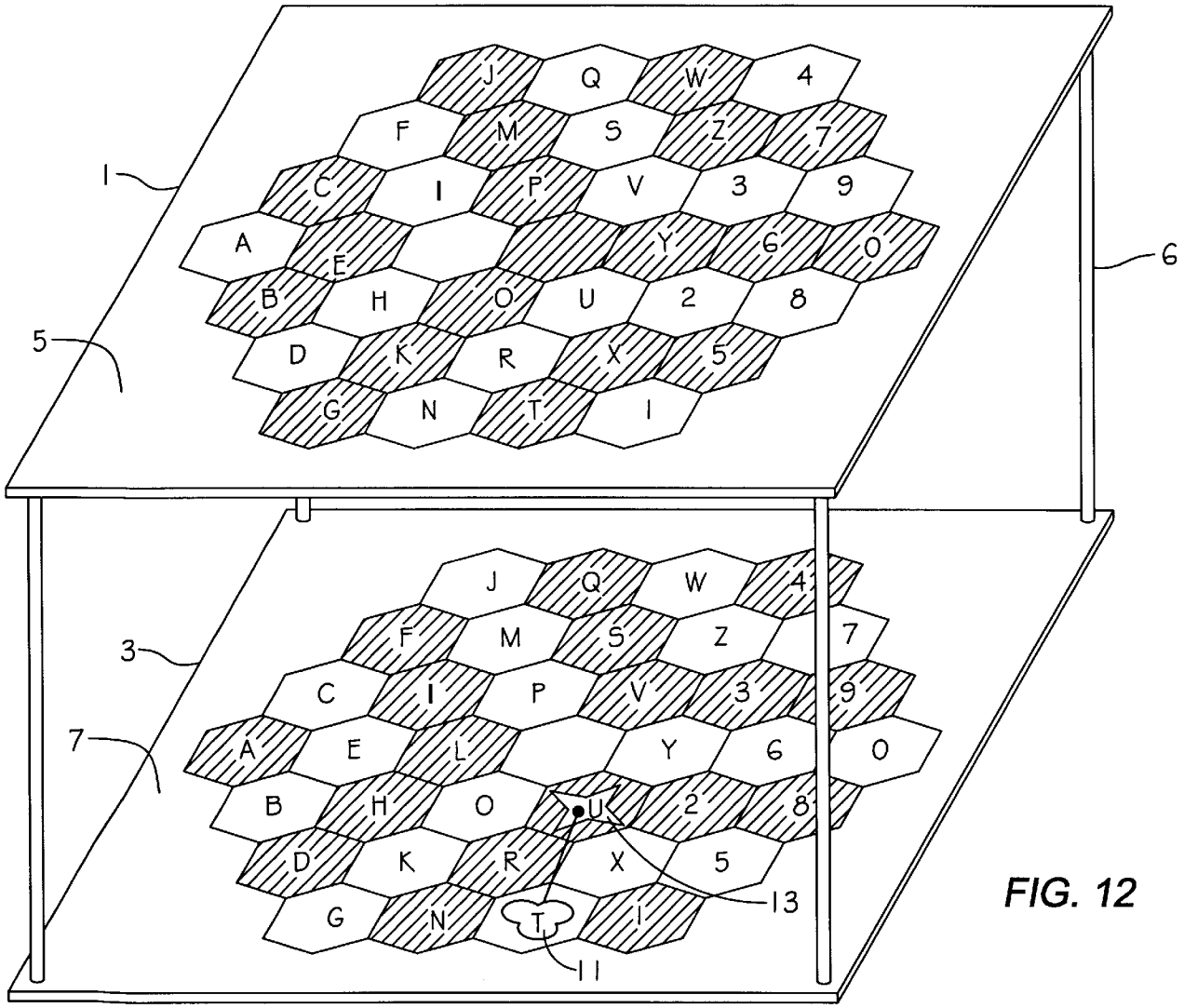
FIG. 12 shows a special movement for the Lantz wherein a Lantz may move horizontally between hexagons to capture an opponents piece if the Lantz is moving directly toward an opponents back row.

A first player starts with one Lantz 11 on hexagon N and one Lantz 11 on hexagon T of the lower playing field 7, FIG. 1 for a total of two. The first player does not have a Lantz on the upper playing field. The second player does not have a Lantz on the lower playing field 7, FIG. 1 but has one Lantz 14 on hexagon Q and one Lantz 14 on hexagon W on the upper playing field 5, FIG. 1. As shown in FIG. 11 the Lantz can move horizontally across any number of hexagons in any of six directions and can move across members of its own team and can land on either color unoccupied hexagon. It cannot capture in a straight line and cannot move across a member of the opposite team in a straight line movement. The Lantz can capture an opponent's piece located above or below in one vertical movement or can move vertically to an unoccupied hexagon. As shown in FIG. 12 the Lantz also has a special horizontal forward capture. When going directly forward toward the opponent's back row the Lantz can move forward between one pair of hexagons to capture on a hexagon which will be either decreasing or increasing alpha-numerically by one from the starting position. As an example a Lantz on the lower playing level on hexagon T could move between hexagon R and X to capture an opponent's piece located on hexagon U; Lantz is moving from T to U. The Lantz on hexagon T cannot move between hexagon R and N because it would not be moving directly toward the opponent's back row and would land on hexagon K which is not a one letter increase or decrease. This specialized forward move can only be made to capture an opponent's piece.

In some embodiments the following table indicating strengths and weaknesses of each piece is affixed to the top rectangle on either side of the playing field to aid the novice player.

| Piece | Movement | Direction of Capture |
|---|---|---|
| HALBERD | 1* | 6 |
| SAEBEL | 2 | 4 |
| LANTZ | 6 | 2 |

*Halberd can move two Hexagons from its own back row

Figure 8:
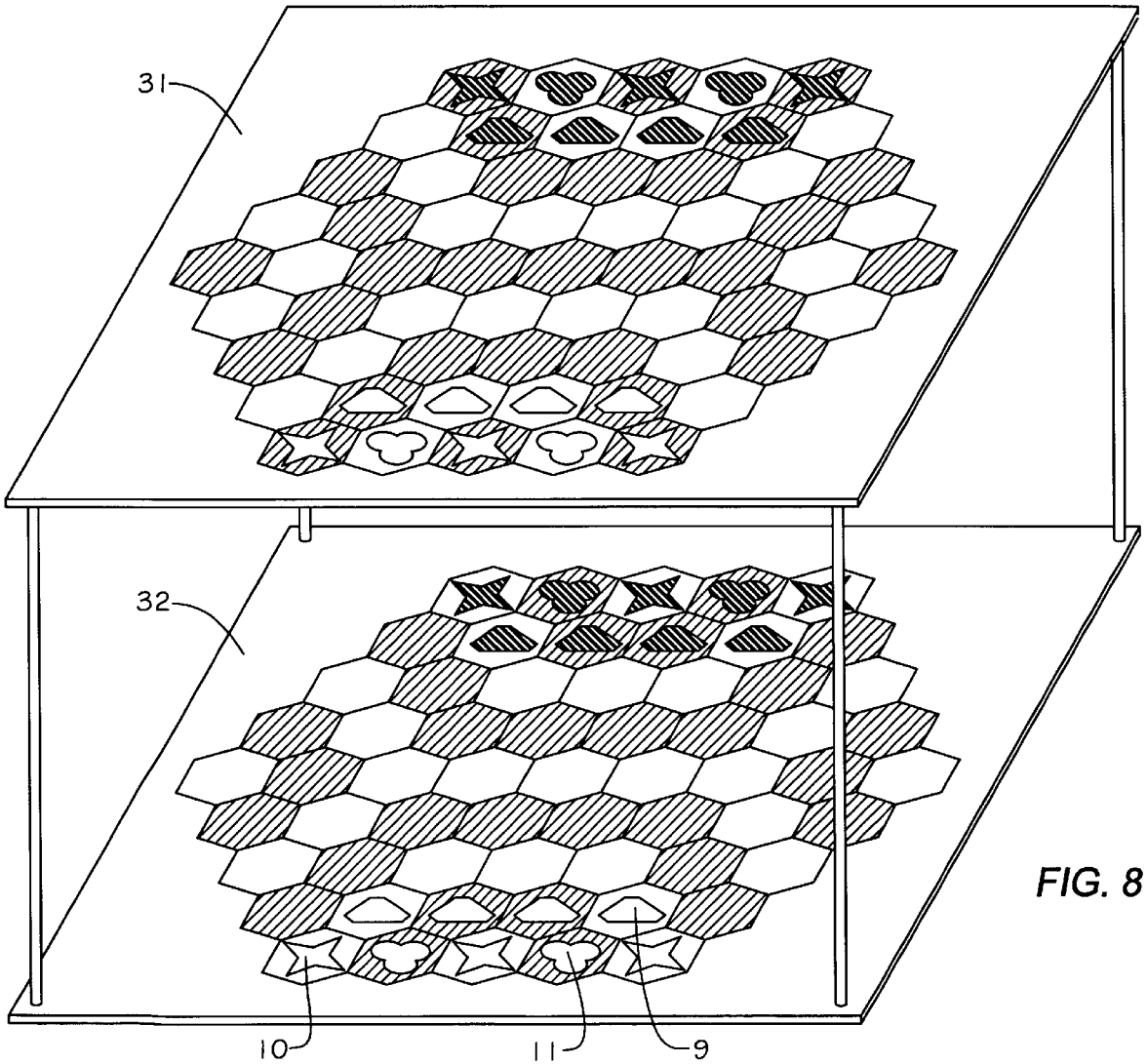
FIG. 8 shows the second embodiment of the invention.

FIG. 8 shows a second embodiment of the invention in which both the upper playing field 31 and the lower playing field 32 are enlarged to sixty one alternating color hexagons. In this embodiment the playing pieces are the same shape and are moved according to the same rules as the first embodiment but at the start of the game each player has eighteen pieces for a total of thirty six pieces. Each player has nine pieces in the back two rows of the upper level 31 and each has nine pieces on the back two rows of the lower level 32. Each player has eight truncated triangle shaped pieces that may be called Halberds, six of the star shaped pieces that may be called Saebels, and four of the trilobal pieces that may be called Lantzs. These are shown in FIGS. 2, 3 4, and in a slightly different version in FIGS. 5, 6, and 7.

Starting positions for this embodiment are as follows:

a first player has a Saebel 10, a Lantz 11, a second Saebel 10, a second Lantz 11, and a third Saebel 10 in order as listed on the back five hexagon row on the lower playing field 32, and has four Halberds 9 adjacent to each other on the row in front of the back row and the first player has exactly the same arrangement of pieces directly above the lower playing field 32 on the upper playing field 31; and the second player has an arrangement of pieces the same as the first player's pieces but on the opposite end from the first player's pieces and of a different color from the first player's pieces.

What is claimed is:

1. A method of play for two players using a dual level board game comprising an upper numbered playing field with 18 hexagons of a first color and 19 hexagons of a second color and a lower numbered playing field with 18 hexagons of said second color and 19 hexagons of said first color with said method of play as follows capturing an opposing player's playing pieces as an object of play, conscripting a captured piece by turning said piece over to said player's color and placing said captured piece in said player's back row on said playing field of said capture, starting a first player with two of said pieces of said first shape on a back row of said lower playing field, and starting said first player with no pieces of said first shape on said upper playing field;

starting a second player with two of said pieces of said first shape on a back row of said upper playing field, and starting said second player with no pieces of said first shape on said lower playing field;

with said each player thereby starting with two pieces of said first shape, each preferably called a Lantz with a first capability, said first capability allowing said player to move said Lantz between two hexagons directly toward an opposite player's starting position to capture one of said opposite player's pieces, to move said Lantz forward horizontally in a straight line in any of six directions across pieces of said Lantz's color and up to pieces of an opposite color and land on any colored hexagon; said Lantz cannot capture in a said straight line;

to move said Lantz vertically to capture an opponent's piece and to move vertically to an unoccupied hexagon;

starting said first player with two of said pieces of said second shape on a back row of said lower playing field, and starting said first player with two of said pieces of said second shape on a back row of said upper playing field, and starting said second player with two of said pieces of said second shape on a back row of said lower playing field, and starting said second player with two of said pieces of said second shape on a back row of said upper playing field, making a total of said four pieces of said second shape for said first player and a total of four pieces for said second player with each of said pieces preferably called a Saebel and having a second capability, said second capability allowing a player:

to move said Saebel in any of six horizontal directions; thereby enabling said Saebel to land on a maximum of six same colored hexagons, to move said Saebel vertically as first move of its two hexagon move limit and to capture by moving sideways to its own color;

starting said first player with two of said pieces of said third shape on a row in front of a back row of said lower playing field, and starting said first player with two of said pieces of said third shape on a back row of said upper playing field, and starting a second player with two of said pieces of said third shape on a back row of said lower playing field, and starting said second player with two of said pieces of said third shape on a row in front of a back row of said upper playing field, making a total of four of said pieces of said second shape for said first player and a total of four pieces of said pieces of said second shape for said second player with each of said pieces preferably called a Halberd and having a third capability, said third capability allowing a player:

to make a first move of said Halberd of two unoccupied hexagons only when starting from its own back row, to move one hexagon at a time after said first move in any of six directions horizontally and capture on said one hexagon move, to move vertically to an unoccupied hexagon since said Halberd cannot capture vertically, concluding a game by one player capturing all the opponent's pieces and also concluding a game when one player has no movable pieces.

2. A method of play for a two players using said method of play as described in claim 1 further comprising allowing a player who has accumulated fourteen pieces to move two different pieces at each turn, and allowing said player to move three different pieces at each turn when said player accumulates fifteen pieces and allowing said player to move four different pieces at a turn after said player has accumulated a minimum of sixteen pieces.

3. A method of play for a two players using said dual level board game comprising an upper numbered playing field with 30 hexagons of a first color and 31 hexagons of a second color and a lower numbered playing with 30 hexagons of said second color and 31 hexagons of said first color by:

using playing pieces with one color on one side and a second color on another side and with each player using playing pieces that are the same color, capturing an opposing player's playing pieces as an object of play, conscripting a captured piece by turning said piece over to said player's color and placing said captured piece in said player's back row on said playing field of said capture, starting each of said two players with two of said pieces of said first shape on a back row of said lower playing field and similarly two of said pieces on a back row of said upper playing field with said each player thereby starting with four pieces of said first shape, each preferably called a Lantz with a first capability, said first capability allowing said player to move said Lantz between two hexagons toward an opposite player's starting position to capture one of said opposite player's pieces, to move said Lantz forward horizontally in a straight line in any of six directions across pieces of said Lantz's color and up to pieces of an opposite color and land on any colored hexagon; said Lantz cannot capture in a said straight line;

to move said Lantz vertically to capture an opponent's piece and to move vertically to an unoccupied hexagon;

starting each player with three pieces of said second shape, each on said first colored hexagon on a back row of said lower playing field and three pieces of said second shape on said second colored hexagon on said upper playing field making a total of said six pieces of said second shape, each preferably called a Saebel and having a second capability, said second capability allowing a player:

to move said Saebel two hexagons horizontally and to jump over a non occupied hexagon and to jump past an occupied hexagon to land on its starting color, to move said Saebel in any of eight horizontal directions; thereby enabling said Saebel to land on a maximum of eight possible same color hexagons, to move said Saebel vertically as first of its two hexagon move limit and to capture by moving sideways to its own color;

to move said Saebel vertically as a first of its two hexagon move limit and finish movement sideways to its own color, starting each player with two pieces of said third shape each on said first colored hexagon and two pieces of said third shape each on said second colored hexagon on a row adjacent to a back row of said lower playing field and two pieces each on said first colored hexagon and two pieces on said second colored hexagon on a row adjacent to said back row of said upper playing field making a total of eight pieces for each of said players of said third shape pieces, each preferably called a Halberd and having a third capability, said third capability allowing a player:

to make a first move of said Halberd of two unocoupied hexagons, to move one hexagon at a time after said first move in any of six directions horizontally and capture on said one hexagon move, to move vertically to an unoccupied hexagon since said Halberd cannot capture vertically:

concluding a game by one player capturing all the opponent's pieces and also concluding a game when one player has no movable pieces.

4. A method of play as described in claim 3 further comprising allowing a player who has accumulated fourteen pieces to move two different pieces at each turn and allowing said player to move three different pieces at each turn when said player accumulates fifteen pieces and allowing said player to move four different pieces at a turn after said player has accumulated a minimum of sixteen pieces.

* * * * *